US009309074B1

(12) United States Patent
Bonino et al.

(10) Patent No.: US 9,309,074 B1
(45) Date of Patent: Apr. 12, 2016

(54) SHEET HEIGHT SENSOR AND ADJUSTER

(71) Applicant: Xerox Corporation, Norwalk, CT (US)

(72) Inventors: Paul S. Bonino, Ontario, NY (US); Steven M. Russel, Bloomfield, NY (US); Paul M. Fromm, Rochester, NY (US); Timothy P. Foley, Marion, NY (US); Frank B. Tamarez Gomez, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/574,448

(22) Filed: Dec. 18, 2014

(51) Int. Cl.

| | |
|---|---|
| ***B65H 5/22*** | (2006.01) |
| ***B65H 5/36*** | (2006.01) |
| ***B65H 5/02*** | (2006.01) |
| ***B65H 9/08*** | (2006.01) |

(52) U.S. Cl.
CPC ..... *B65H 5/36* (2013.01); *B65H 5/021* (2013.01); *B65H 5/224* (2013.01); *B65H 9/08* (2013.01); *B65H 2301/44322* (2013.01); *B65H 2404/64* (2013.01)

(58) Field of Classification Search
CPC ..... B65H 5/224; B65H 2404/64
See application file for complete search history.

(56) References Cited

U.S. PATENT DOCUMENTS

| | | | | |
|---|---|---|---|---|
| 2,937,739 | A | | 5/1960 | Levy |
| 3,588,090 | A | | 6/1971 | Dayton et al. |
| 3,665,743 | A | | 5/1972 | Frohling |
| 3,743,118 | A | | 7/1973 | Fluck |
| 4,411,420 | A | * | 10/1983 | Louis ..... B65H 5/224 271/197 |
| 4,433,599 | A | * | 2/1984 | Mundus ..... B31B 19/96 83/112 |
| 4,561,819 | A | | 12/1985 | Wiernicki |
| 4,627,718 | A | * | 12/1986 | Wyer ..... B65H 5/36 162/271 |
| 4,750,660 | A | * | 6/1988 | Kamimura ..... B21D 43/023 242/548.2 |
| 5,270,778 | A | * | 12/1993 | Wyer ..... B65H 5/38 162/271 |
| 5,704,607 | A | * | 1/1998 | Brotherston ..... B65H 3/34 271/104 |
| 6,141,883 | A | | 11/2000 | Mitchell et al. |
| 7,118,103 | B2 | * | 10/2006 | Greive ..... B65H 5/021 162/369 |
| 7,328,517 | B2 | | 2/2008 | Kirstine |
| 8,201,824 | B2 | | 6/2012 | deJong et al. |
| 2014/0166443 | A1 | | 6/2014 | Shinobu |

* cited by examiner

*Primary Examiner* — Gene Crawford
*Assistant Examiner* — Thomas Randazzo
(74) *Attorney, Agent, or Firm* — Gibb & Riley, LLC

(57) ABSTRACT

An apparatus includes a conveyor that has a planar surface supporting sheets of media. A movable element is positioned adjacent the planar surface at an initial position. The initial position is a first distance from the surface approximately equal to the thickness of a sheet of media. The movable element moves in a first direction away from the surface and in a second direction toward the surface. An actuator is connected to the movable element. The actuator detects when the movable element moves in the first direction from the initial position. In response to the movable element moving in the first direction, the actuator moves the movable element in the second direction to a pushing position. The pushing position is between the initial position and the surface. After moving the movable element to the pushing position, the actuator allows the movable element to return to the initial position.

20 Claims, 8 Drawing Sheets

SHEET HEIGHT SENSOR AND ADJUSTER

BACKGROUND

Systems and methods herein generally relate to conveyor systems that move sheets, and more particularly to apparatuses that determine the sheet height of a sheet on a conveyor.

As the quality and speed of printing devices improve, the tolerances within such printing devices decrease. These tighter tolerances can cause problems if the print media being utilized has an inconsistent thickness. Specifically, if a sheet of print media is thicker than the tolerances within the printing device, the print media can jam within the printing device and/or damage the internals of the printing device. Therefore, systems that can determine the height of the print media accurately are highly valued.

For example, in a direct marking ink jet printer, the print heads are at risk of damage if struck by media on which the print heads are jetting. Typically print heads are within 1 mm from the media. Cut sheet printers add a degree of difficulty over a web fed printer because cut sheets are more difficult to constrain. Furthermore, cut sheets are prone to cockle and curl. There it is useful to measure the sheet height above the paper path in order to inform the system that a potentially hazardous sheet is about to enter the print zone.

SUMMARY

An exemplary generic apparatus herein includes a conveyor that has a planar surface supporting sheets of media. The conveyor moves the sheets of media in a process direction. A movable element has an end that is positioned adjacent to the planar surface of the conveyor, at an initial position. This "initial position" is a first distance from the surface of the conveyor that is approximately equal to a thickness limit for the sheets of media. The first distance represents a limit of how high above the surface of the conveyor a sheet is allowed to be positioned. Therefore, the first distance can be, for example, approximately equal to 90% (e.g., 95%, 85%, etc.) of the height that a low clearance structure extends in the first direction above the surface.

The end of the movable element moves in a first direction away from the surface of the conveyor (e.g., upward) and in a second direction toward the surface of the conveyor (e.g., downward). The first direction (e.g., upward) and the second direction (e.g., downward) are within a single linear path. The single linear path is perpendicular to the surface of the conveyor.

Also, an actuator is connected to the movable element, and the actuator has electrical contacts that actuate the actuator. In addition, a biasing member biases the movable element in the first direction (e.g., upward) to position the end of the movable element in the initial position.

The end of the movable element moves in the first direction (e.g., upward) from the initial position as a result of the end of the movable element contacting a sheet of media on the conveyor, as the sheet of media is moved in the process direction by the conveyor. In other words, if a portion of a sheet is above the height limit (the initial position), that portion of the sheet will push the end of the movable element away from the surface of the conveyor (e.g., upward). The electrical contacts contact each other as a result of the movable element moving in the first direction (e.g., upward).

As a result of the electrical contacts contacting each other, the actuator moves the end of the movable element in the second direction (e.g., downward) to a pushing position to cause the end of the movable element to push the sheet of media downward against the surface of the conveyor, thereby forcing the sheet back down below the height limit represented by the initial position. The pushing position is, therefore, located between the initial position and the surface of the conveyor. For example, the pushing position can be less than 80% (e.g., 60%, 45%, 20%, etc.) of the first distance from the surface of the conveyor. The movable element contacts the sheet of media and pushes the sheet of media towards the surface, when the movable element is in the pushing position.

After moving the end of the movable element to the pushing position, the electrical contacts of the actuator are separated, allowing the biasing member to return the end of the movable element back to the initial position.

An exemplary printing apparatus herein includes a vacuum conveyor belt that has a planar surface having vacuum openings supporting sheets of print media. The vacuum conveyor belt moves the sheets of print media in a process direction. An array of sheet adjustment elements is positioned adjacent to the planar surface of the vacuum conveyor belt. Each sheet adjustment element of the array is aligned with one of the rows of openings in the surface of the vacuum conveyor belt. Further, each sheet adjustment element comprises a pin, an actuator, and a spring.

The pin has an end that is positioned adjacent the planar surface of the vacuum conveyor belt, at an initial position. This "initial position" is a first distance from the surface of the vacuum conveyor belt that is approximately equal to a thickness limit for the sheets of print media. The first distance represents a limit of how high above the surface of the vacuum conveyor belt a sheet is allowed to be positioned. Therefore, the first distance can be, for example, approximately equal to 90% (e.g., 95%, 85%, etc.) of the height that the print heads extend in the first direction above the surface.

The end of the pin moves in a first direction away from the surface of the vacuum conveyor belt (e.g., upward) and in a second direction toward the surface of the vacuum conveyor belt (e.g., downward). The first direction (e.g., upward) and the second direction (e.g., downward) are within a single linear path. The single linear path is perpendicular to the surface of the vacuum conveyor belt.

Also, the actuator is connected to the pin, and the actuator has electrical contacts that actuate the actuator. In addition, a spring biases the pin in the first direction (e.g., upward) to position the end of the pin in the initial position.

The end of the pin moves in the first direction (e.g., upward) from the initial position as a result of the end of the pin contacting a sheet of print media on the vacuum conveyor belt, as the sheet of print media is moved in the process direction by the vacuum conveyor belt. In other words, if a portion of a sheet is above the height limit (the initial position), that portion of the sheet will push the end of the pin away from the surface of the vacuum conveyor belt (e.g., upward). The electrical contacts contact each other as a result of the pin moving in the first direction (e.g., upward).

As a result of the electrical contacts contacting each other, the actuator moves the end of the pin in the second direction (e.g., downward) to a pushing position to cause the end of the pin to push the sheet of print media downward against the surface of the vacuum conveyor belt, thereby forcing the sheet back down below the height limit represented by the initial position. The pushing position is, therefore, located between the initial position and the surface of the vacuum conveyor belt. For example, the pushing position can be less than 80% (e.g., 60%, 45%, 20%, etc.) of the first distance from the surface of the vacuum conveyor belt. The pin contacts the sheet of print media and pushes the sheet of print media towards the surface, when the pin is in the pushing position.

After moving the end of the pin to the pushing position, the electrical contacts of the actuator are separated, allowing the spring to return the end of the pin back to the initial position.

These and other features are described in, or are apparent from, the following detailed description.

BRIEF DESCRIPTION OF THE DRAWINGS

Various exemplary systems and methods are described in detail below, with reference to the attached drawing figures, in which.

DETAILED DESCRIPTION

As shown above, it is highly useful to determine the height of a sheet of media above a conveyor in order to prevent damage to internal structures within printers and other devices and to prevent sheet jams, paper jams, etc. In view of this, various devices are described herein that sense the height of a sheet in several locations across the sheet and adjust the sheet downward toward the conveyor if the sheet exceeds a height limit. Thus, if a sheet exceeds the allowable height, the devices herein actively push the sheet downward.

In one example, devices herein use an array of spring-loaded "push pins" that have a very light spring force pushing downward. The array is located in the cross-process direction of the paper path (e.g., perpendicular to the process direction). This assists sheet capture on a vacuum transport. Paper that is cockled or curled may sometimes be undesirably lifted in certain regions above the vacuum transport. The pin heads of the devices herein are located at the maximum allowable height of the paper. Paper having a height exceeding the allowable height from the vacuum transport lifts a pin or pins. When a pin is lifted upward, an electrical connection is made and a coil located around the pin is energized, forcing the pin to push downward. The added localized force instantaneously tacks the sheet downward so that it can be acquired by the vacuum transport.

Each of the pins can be located over a row of vacuum belt holes so that the paper is most likely to be acquired by the vacuum transport belt when pushed downward by the pins. The response time of the pin can be very fast and this performance can be achieved using a low mass pin. The duration the coil is energized is very short to prevent the pin from dragging on the paper. After the actuation occurs, the pin is returned to its original position at the maximum allowable height of the paper by a spring. Thus, the devices herein both sense and correct (adjust) a raised sheet. A sense transistor is electrically attached to each pin's electrical circuit. In some situations, logic is added to the device to record the number of actuations (or location of actuations).

Figure 1:
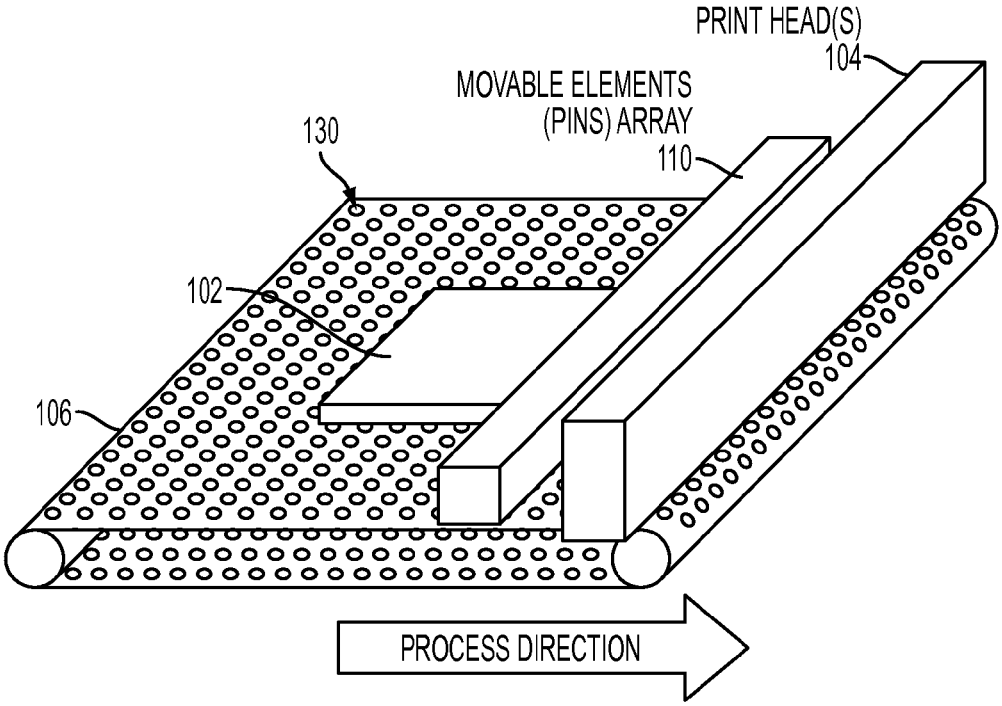
FIG. 1 is a schematic perspective diagram illustrating devices herein.
Figure 2:
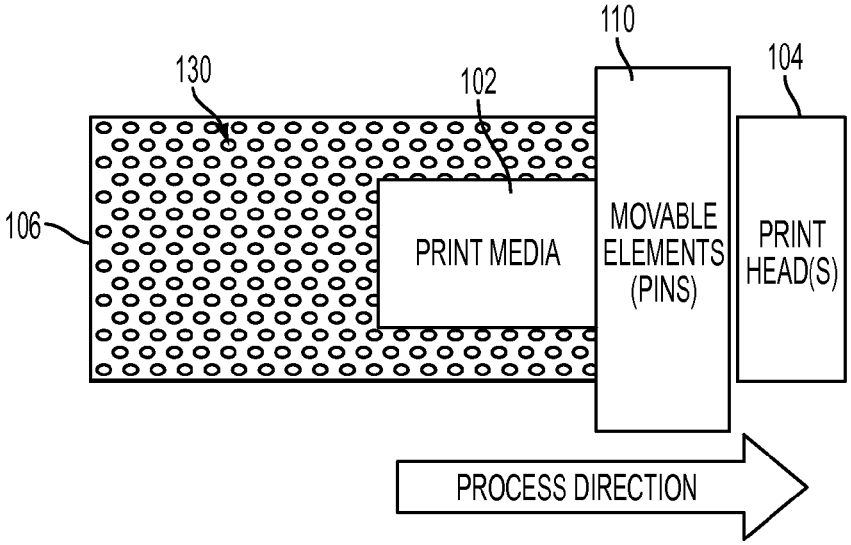
FIG. 2 is a schematic top-view diagram illustrating devices herein.
Figure 3:
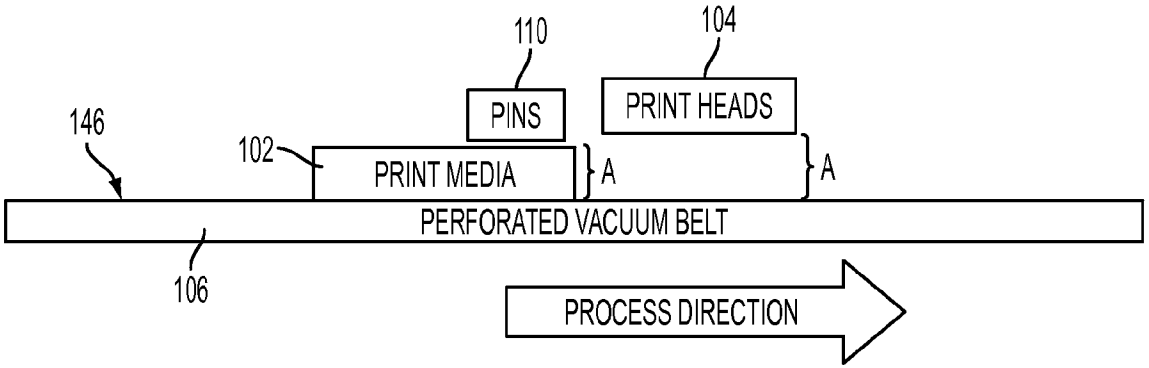
FIG. 3 is a schematic side-view diagram illustrating devices herein.

Therefore, as shown for example in perspective view in FIG. 1, top view in FIG. 2, and side view in FIG. 3, an exemplary printing apparatus herein includes a vacuum conveyor belt 106 that has a planar surface 146 with openings 130 therein supporting sheets of print media 102. The vacuum conveyor belt 106 moves the sheets of print media 102 in a process direction.

As would be understood by those ordinarily skilled in the art, the devices herein are useful with any form of conveyor system and a vacuum conveyor belt 106 is only utilized as one of many examples. Therefore, item 106 is intended to represent any form of conveyor belt (perforated or non-perforated), roller system, or any other transport system that can move sheets. Similarly, while the sheets are described as print media sheets 102, those ordinarily skilled in the art would understand that the sheets can represent any form of sheet that can be moved by a conveyor where the height of that sheet above the conveyor is an element that is to be controlled. Therefore, similarly, item 102 is intended to represent any type of sheet that can be moved along any type of conveyor.

As also shown in FIGS. 1-4, an array 110 of sheet adjustment elements 140 (shown in greater detail in the FIGS. 5-9) is positioned adjacent the planar surface 146 of the vacuum conveyor belt 106. The array is positioned perpendicular to the process direction (shown by arrow in the drawings) and parallel to the surface 146 of the conveyor belt 106. As shown best in FIG. 4, each sheet adjustment element 140 of the array 110 can be, in some situations, aligned with one of the openings 130 in the surface 146 of the vacuum conveyor belt 106 (if the conveyor 106 includes such openings 130). As noted above, the sheet adjustment elements 140 push down on a portion of the sheet if that sheet portion is above a height limit (represented by identifier "A" in FIG. 3).

Figure 4:
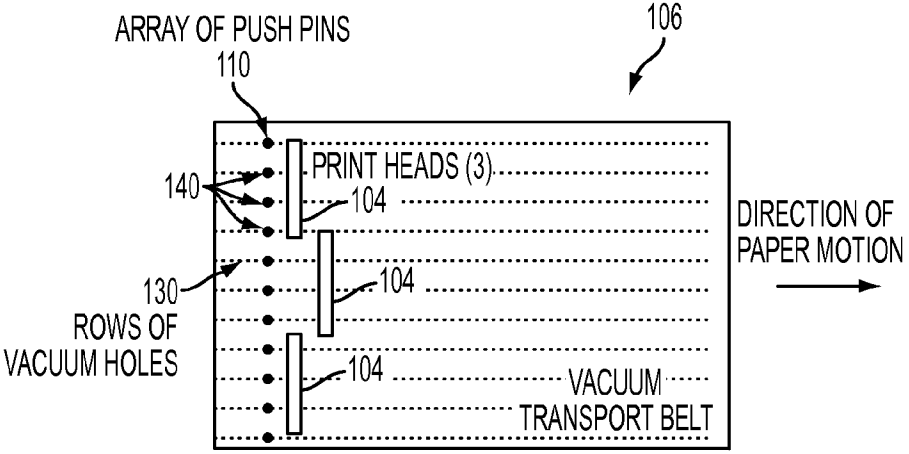
FIG. 4 is a schematic top-view diagram illustrating devices herein.

By aligning the sheet adjustment elements 140 with the rows of openings 130 in the vacuum conveyor belt 106 as shown in FIG. 4, each of the sheet adjustment elements 140 pushes the portion of the sheet 102 that exceeds the height limit against one of the vacuum holes 130, thereby increasing the likelihood that the over-height portion of the sheet will reattach firmly to the vacuum belt 106 (by operation of the vacuum force being applied by the opening 130); which in turn reduces the likelihood that any part of the sheet exiting the array 110 will exceed the height limit.

Figure 5:
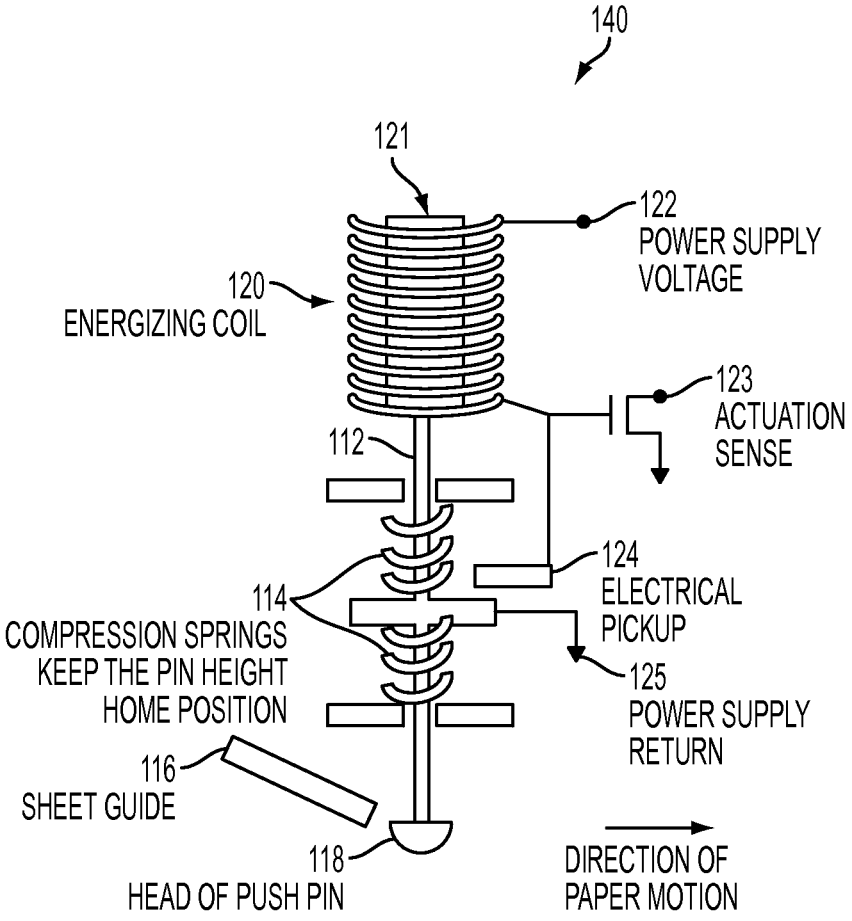
FIG. 5 is a schematic side-view diagram illustrating devices herein.

FIG. 5 illustrates a single sheet sensing/adjusting element 140, many of which are within the array 110. As shown in FIG. 5, each sheet adjustment element 140 within the array 110 follows a sheet guide 116 comprises a movable element (e.g., a pin, bar, rod, beam, shaft, etc.) 112, an actuator (which is illustrated as components 120-125), and a biasing member 114 (e.g., a spring, piston, rubber band or belt, a counterweight with pulley, etc.). Thus, each sheet sensing/adjusting device 140 is a self-contained, self-sensing, self-actuated device, and these elements allow each sheet sensing/adjusting element 140 to act independently of the other sheet sensing/adjusting elements, and to act without being controlled by a central controller or central logic (avoiding such expense and complexity).

The end 118 of the movable element 112 moves in a first direction (shown by identification number 144 in FIG. 7) away from the surface 146 of the vacuum conveyor belt 106 (e.g., upward) and in a second direction (shown by identification numeral 148 in FIG. 8) toward the surface 146 of the vacuum conveyor belt 106 (e.g., downward). The first direction 144 (e.g., upward) and the second direction 148 (e.g., downward) are within a single linear path. The single linear path is perpendicular to the planar surface 146 of the vacuum conveyor belt 106.

The actuator 120-125 can be any form of actuator, including electromagnetic actuator, pneumatic actuator, hydraulic actuator, etc. (and components 120-125 are intended to illustrate all such variations of actuators). In the specific example shown in FIG. 5, the actuator includes an energizing coil 120 surrounding a magnetic element 121. A power supply voltage 122 applied to the energizing coil 120 causes the magnetic element 121 (that is physically connected to the movable element 112) to move relative to the energizing coil 120 if the power supply voltage 122 can pass through the power supply return 125. The actuation sensor 123 and electrical pickup 124 allow the current to flow to the power supply return 125 when the electrical pickup contact 124 makes physical and electrical contact with the power supply return 125 (as illustrated, for example, in FIG. 7 discussed below).

Figure 8:
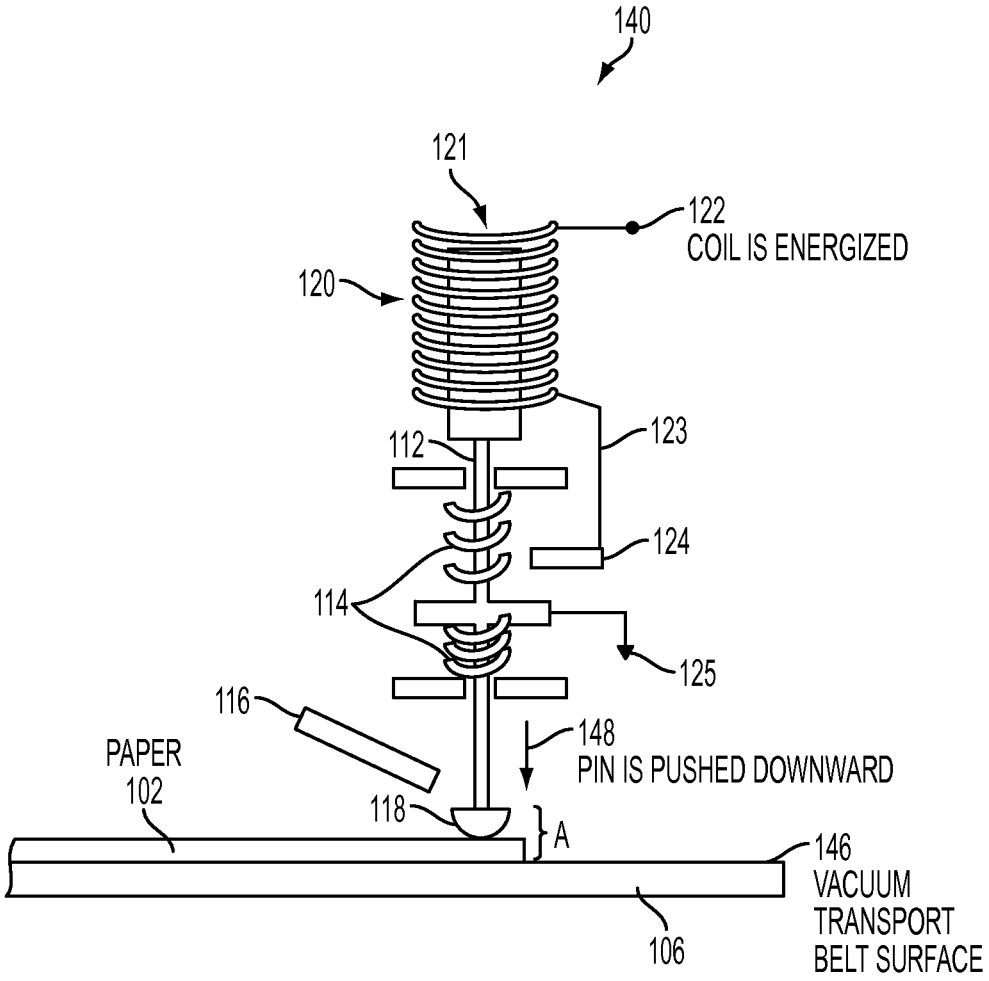
FIG. 8 is a schematic side-view diagram illustrating devices herein.

In other words when electrical contact device 125 makes physical contact with electrical contact device 124, a circuit is completed allowing the power supply voltage 122 to be applied to the energizing coil 120 and to flow through the power supply return 125. Flowing current/voltage through the energizing coil 120 moves the magnetic element 121 within the energizing coil 120, which in turn moves the movable element 112, and which in turn moves the end 118 of the movable element 112 (as shown in FIG. 8 discussed below). Thus, the actuator 120-125 is connected to the movable element 112, and the actuator 120-125 has electrical contacts 124, 125 that actuate the actuator 120-125.

Figure 6:
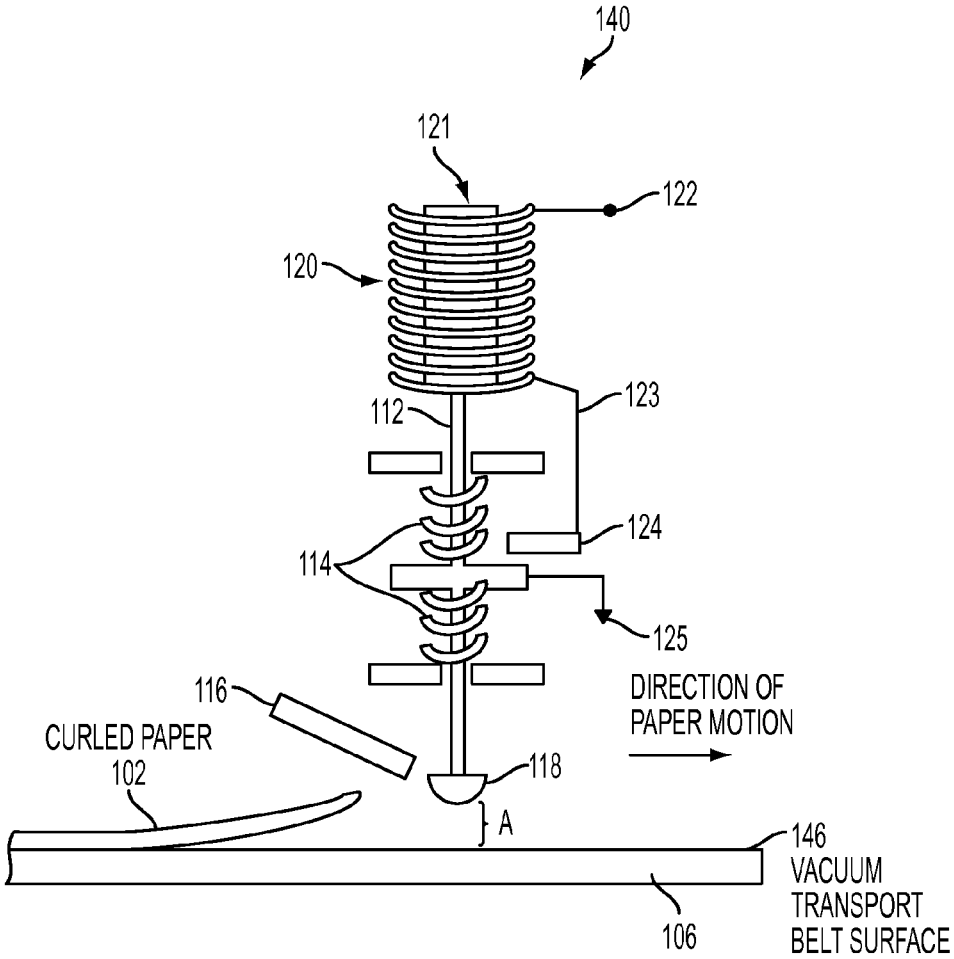
FIG. 6 is a schematic side-view diagram illustrating devices herein.
Figure 9:
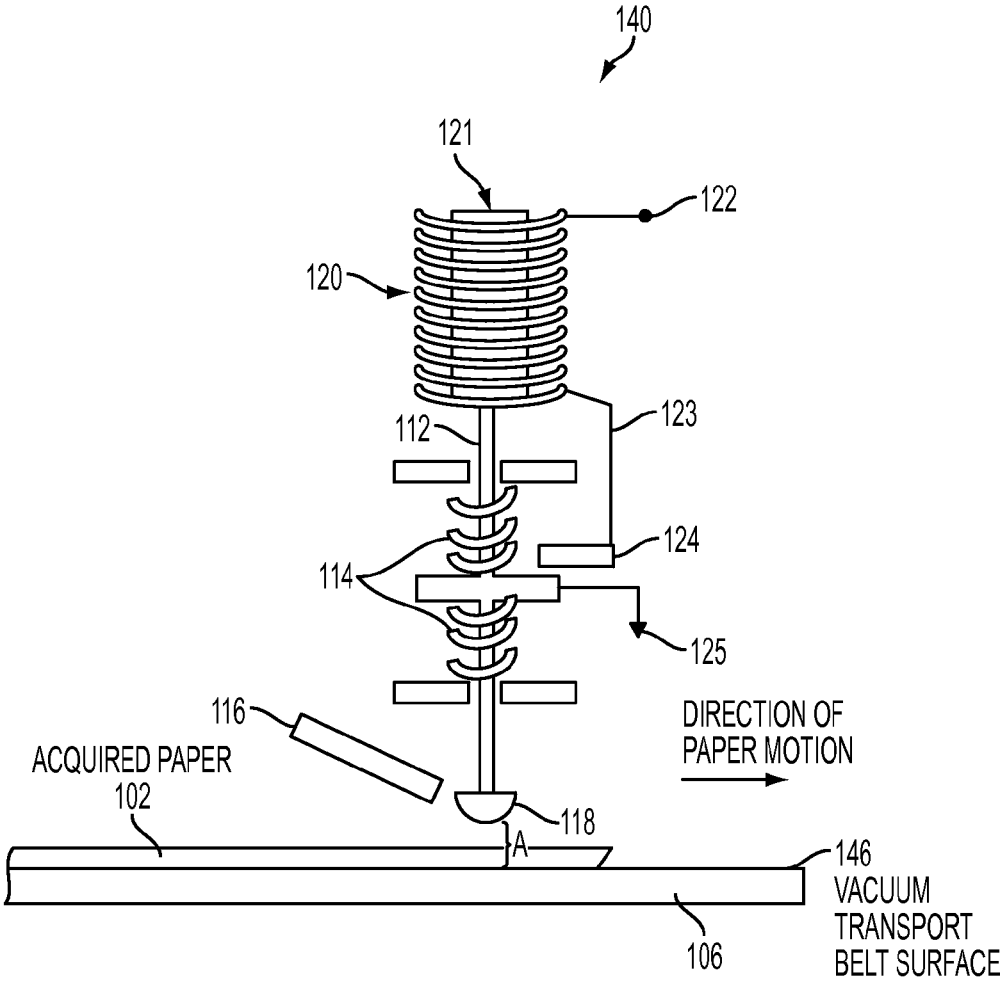
FIG. 9 is a schematic side-view diagram illustrating devices herein.

As shown in FIG. 6, the end 118 of the movable element 112 is positioned adjacent the planar surface 146 of the vacuum conveyor belt 106, at the initial position A (shown in FIGS. 6 and 9). This "initial position" is a first distance A from the surface 146 of the vacuum conveyor belt 106 that is approximately equal to a thickness limit for the sheets of print media 102. The first distance A represents a limit of how high above the surface 146 of the vacuum conveyor belt 106 the sheet 102 is allowed to be positioned, because any sheets that extend above the first distance A may contact the print heads 104, resulting in a paper jam or damage to the print heads 104.

The first distance A is established based upon the height that the print heads 104 (and/or other height-limiting structure within the apparatus) extend in the first direction above the surface 146 of the conveyor belt 106. To provide a relative measure, the first distance A can be, for example, approximately equal to 90% (e.g., 95%, 85%, etc.) of the height that the print heads 104 extend in the first direction above the surface 146.

Figure 7:
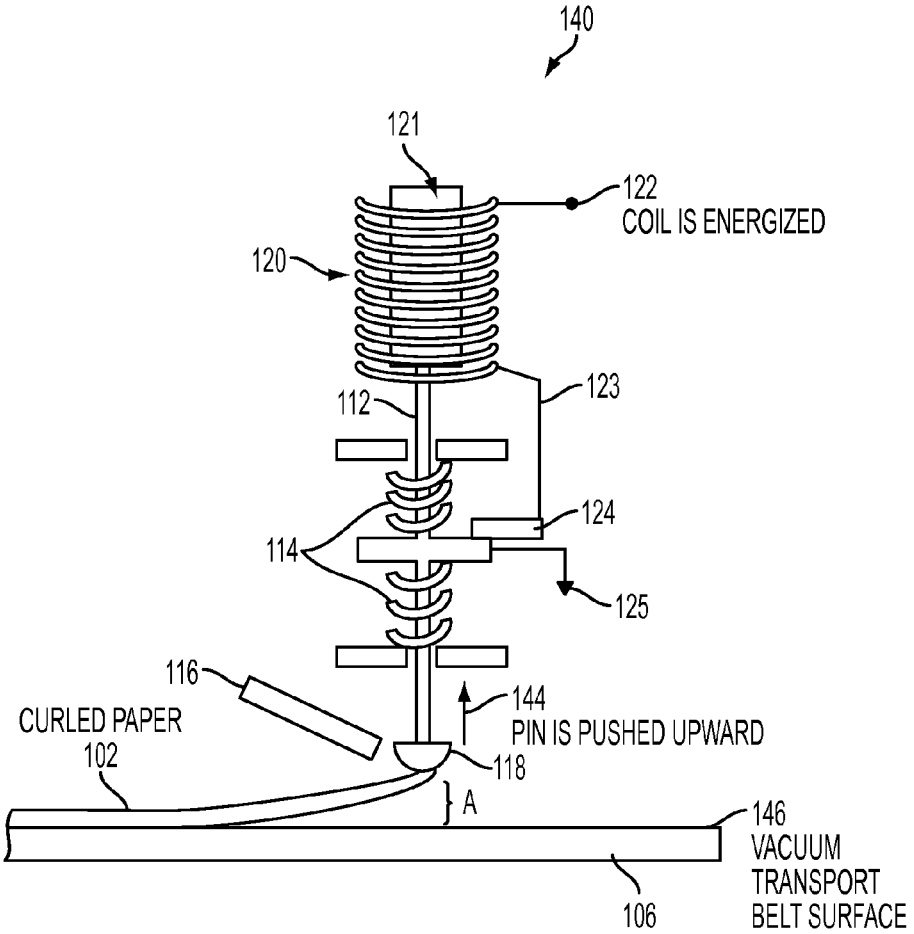
FIG. 7 is a schematic side-view diagram illustrating devices herein.

In addition, the biasing member 114 biases the movable element 112 in the first direction 144 (e.g., upward) to position the end 118 of the movable element 112 in the initial position A (shown in FIGS. 6 and 9) until/unless the moveable element 112 is acted upon by another force, such as force from the sheet of media 102 or force from the actuator 120-125 (shown in FIGS. 7 and 8).

FIG. 6 illustrates a situation where a sheet of media 102 has a portion that extends above the surface 146 of the conveyor 106 an amount greater than the limit of the first distance A. In FIG. 7, this excess-height portion of the sheet of media 102 physically contacts the end 118 of the movable element 112 and pushes the movable element 112 in the first direction 144 (upward).

Thus, the end 118 of the movable element 112 moves in the first direction 144 (e.g., upward) from the initial position A (shown in FIGS. 6 and 9) as a result of the end 118 of the movable element 112 contacting the sheet of print media 102 on the vacuum conveyor belt 106, as the sheet of print media 102 is moved in the process direction by the vacuum conveyor belt 106. In other words, if a portion of a sheet is above the height limit (the initial position A), that portion of the sheet will push the end 118 of the movable element 112 away from the surface 146 of the vacuum conveyor belt 106 (e.g., upward). The electrical contacts 124, 125 contact each other as a result of the movable element 112 moving in the first direction 144 (e.g., upward).

As shown in FIG. 8, as a result of the electrical contacts contacting each other, the actuator 120-125 moves the end 118 of the movable element 112 in the second direction 148 (e.g., downward) to a pushing position to cause the end 118 of the movable element 112 to push the sheet of print media 102 downward against the surface 146 of the vacuum conveyor belt 106, thereby forcing the sheet back down below the height limit represented by the initial position A. As noted above, each sensing/adjusting structure 140 can act independently when so pushing down the excess-height portion of the sheet of media 102.

This "pushing position" is the position of the movable element 112 shown in FIG. 8, and is, therefore, a position where the end 118 of the movable element 112 is located between the initial position A (shown in FIGS. 6 and 9) and the surface 146 of the vacuum conveyor belt 106. For example, the pushing position can be less than 80% (e.g., 60%, 45%, 20%, etc.) of the first distance A from the surface 146 of the vacuum conveyor belt 106. The movable element 112 contacts the sheet of print media 102 and pushes the sheet of print media 102 towards the surface 146, when the movable element 112 is in the pushing position, as shown in FIG. 8.

As noted, the movable element 112 has an end 118 (head, etc.) that has a rounded or flattened shape (that has a larger surface area than a cross section of the movable element 112) that will push against the print media 102 without tearing or breaching the print media. This allows the end of 118 to push the print media 102 without damaging the print media 102.

After moving the end 118 of the movable element 112 to the pushing position, the electrical contacts of the actuator 120-125 are separated, allowing the biasing member 114 to return the end 118 of the movable element 112 back to the initial position A (as shown in FIG. 9) as a result of the force applied to the movable element 112 by the biasing member 114.

Figure 10:
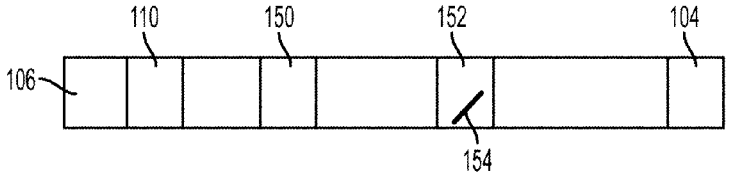
FIG. 10 is a schematic top-view diagram illustrating devices herein.

FIG. 10 illustrates one structure that can be utilized to prevent sheets that exceed the height limit from reaching the print heads. More specifically, FIG. 10 illustrates the height checking/adjusting array discussed above in FIGS. 1-9 as item 110, a second height checker 150, and a diverter 152. In operation (as controlled by the controller discussed below) as a sheet of print media moves along the belt 106, if the second height sensor 150 determines that the sheet of print media is still above the height limit A, even after passing through the height checking/adjusting array 110, the diverter 152 can include a movable element 154 (e.g., arm, drop shoot, air knife, etc.) that diverts the sheet of print media off the belt 106 (potentially into a recycle bin or other waste device). This prevents any over-height sheets from reaching the print heads 104, preventing paper jams and potential damage to the print heads. Alternatively, the printer can be stopped before the sheet of media reaches the print heads 104 to allow manual removal of the sheet.

Figure 11:
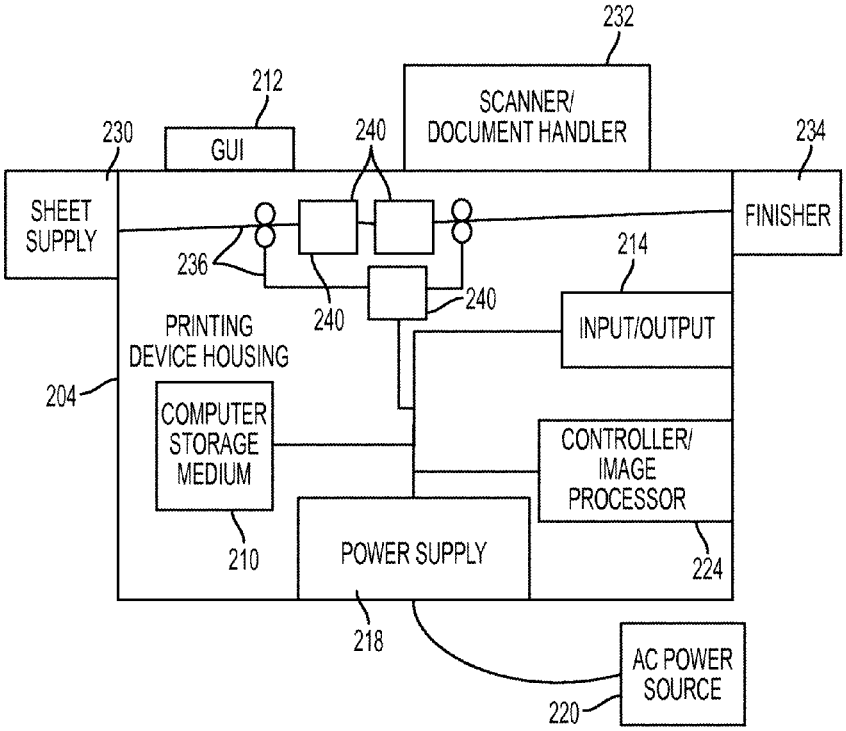
FIG. 11 is a schematic side-view diagram illustrating devices herein.

FIG. 11 illustrates a printing device 204, which can be used with systems and devices herein and can comprise, for example, a printer, copier, multi-function machine, multi-function device (MFD), etc. The printing device 204 includes a controller/tangible processor 224 and a communications port (input/output) 214 operatively connected to the tangible processor 224 and to the computerized network external to the printing device 204. Also, the printing device 204 can include at least one accessory functional component, such as a graphical user interface (GUI) assembly 212. The user may receive messages, instructions, and menu options from, and enter instructions through, the graphical user interface or control panel 212.

The input/output device 214 is used for communications to and from the printing device 204 and comprises a wired device or wireless device (of any form, whether currently known or developed in the future). The tangible processor 224 controls the various actions of the computerized device. A non-transitory, tangible, computer storage medium device 210 (which can be optical, magnetic, capacitor based, etc., and is different from a transitory signal) is readable by the tangible processor 224 and stores instructions that the tangible processor 224 executes to allow the computerized device to perform its various functions, such as those described herein. Thus, as shown in FIG. 11, a body housing has one or more functional components that operate on power supplied from an alternating current (AC) source 220 by the power supply 218. The power supply 218 can comprise a common power conversion unit, power storage element (e.g., a battery, etc), etc.

The printing device 204 includes at least one marking device (printing engine(s)) 240 operatively connected to a specialized image processor 224 (that is different than a general purpose computer because it is specialized for processing image data), a media path 236 positioned to supply continuous media or sheets of media from a sheet supply 230 to the marking device(s) 240, etc., and the media path includes the sheet height sensor 120 discussed above and shown in FIGS. 1-8. After receiving various markings from the printing engine(s) 240, the sheets of media can optionally pass to a finisher 234 which can fold, staple, sort, etc., the various printed sheets. Also, the printing device 204 can include at least one accessory functional component (such as a scanner/document handler 232 (automatic document feeder (ADF)), etc.) that also operate on the power supplied from the external power source 220 (through the power supply 218).

The one or more printing engines 240 are intended to illustrate any marking device that applies a marking material (toner, inks, etc.) to continuous media or sheets of media, whether currently known or developed in the future and can include, for example, devices that use a photoreceptor belt or an intermediate transfer belt, or devices that print directly to print media (e.g., inkjet printers, ribbon-based contact printers, etc.).

As would be understood by those ordinarily skilled in the art, the printing device 204 shown in FIG. 11 is only one example and the systems and devices herein are equally applicable to other types of printing devices that may include fewer components or more components. For example, while a limited number of printing engines and paper paths are illustrated in FIG. 11, those ordinarily skilled in the art would understand that many more paper paths and additional printing engines could be included within any printing device used with systems and devices herein.

While some exemplary structures are illustrated in the attached drawings, those ordinarily skilled in the art would understand that the drawings are simplified schematic illustrations and that the claims presented below encompass many more features that are not illustrated (or potentially many less) but that are commonly utilized with such devices and systems. Therefore, Applicants do not intend for the claims presented below to be limited by the attached drawings, but instead the attached drawings are merely provided to illustrate a few ways in which the claimed features can be implemented.

Many computerized devices are discussed above. Computerized devices that include chip-based central processing units (CPU's), input/output devices (including graphic user interfaces (GUI), memories, comparators, tangible processors, etc.) are well-known and readily available devices produced by manufacturers such as Dell Computers, Round Rock Tex., USA and Apple Computer Co., Cupertino Calif., USA. Such computerized devices commonly include input/output devices, power supplies, tangible processors, electronic storage memories, wiring, etc., the details of which are omitted herefrom to allow the reader to focus on the salient aspects of the systems and devices described herein. Similarly, printers, copiers, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known and are not described in detail herein to keep this disclosure focused on the salient features presented. The systems and devices herein can encompass systems and devices that print in color, monochrome, or handle color or monochrome image data. All foregoing systems and devices are specifically applicable to electrostatographic and/or xerographic machines and/or processes.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms automated or automatically mean that once a process is started (by a machine or a user), one or more machines perform the process without further input from any user.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. Unless specifically defined in a specific claim itself, steps or components of the systems and methods herein cannot be implied or imported from any above example as limitations to any particular order, number, position, size, shape, angle, color, or material.

What is claimed is:

1. An apparatus comprising:

a conveyor having a planar surface supporting sheets of media;

a movable element positioned adjacent said planar surface at an initial position, said initial position being a first distance from said surface approximately equal to a thickness of a sheet of media, said movable element moving in a first direction away from said surface and in a second direction toward said surface; and an actuator connected to said movable element, said actuator detecting said movable element moving in said first direction from said initial position, in response to said detecting said movable element moving in said first direction, said actuator moving said movable element in said second direction to a pushing position, said pushing position being between said initial position and said surface, and after said moving said movable element to said pushing position, said actuator allowing said movable element to return to said initial position.

2. The apparatus according to claim 1, said movable element contacting said sheet of media and pushing said sheet of media towards said surface when said movable element is in said pushing position.

3. The apparatus according to claim 1, said first direction and said second direction being within a single linear path, said single linear path being perpendicular to said surface.

4. The apparatus according to claim 1, said first distance being approximately equal to 90% of a height that a height-limiting structure extends in the first direction above the surface.

5. The apparatus according to claim 1, said pushing position being less than 80% of said first distance from said surface.

6. An apparatus comprising:

a conveyor having a planar surface supporting sheets of media, said conveyor moving said sheets of media in a process direction;

a movable element having an end positioned adjacent said planar surface at an initial position, said initial position being a first distance from said surface approximately equal to a thickness of a sheet of media, said end of said movable element moving in a first direction away from said surface and in a second direction toward said surface;

an actuator connected to said movable element; and a biasing member biasing said movable element in said first direction to position said end in said initial position, said end of said movable element moving in said first direction from said initial position as a result of said end of said movable element contacting said sheet of media as said sheet of media moves in said process direction, in response to said end of said movable element moving in said first direction, said actuator moving said end of said movable element in said second direction to a pushing position to push said sheet of media against said surface, said pushing position being between said initial position and said surface, and after said moving said end of said movable element to said pushing position, said actuator allowing said biasing member to return said end of said movable element to said initial position.

7. The apparatus according to claim 6, said movable element contacting said sheet of media and pushing said sheet of media towards said surface when said movable element is in said pushing position.

8. The apparatus according to claim 6, said first direction and said second direction being within a single linear path, said single linear path being perpendicular to said surface.

9. The apparatus according to claim 6, said first distance being approximately equal to 90% of a height that a height-limiting structure extends in the first direction above the surface.

10. The apparatus according to claim 6, said pushing position being less than 80% of said first distance from said surface.

11. An apparatus comprising:

a conveyor having a planar surface supporting sheets of media, said conveyor moving said sheets of media in a process direction; and an array of sheet adjustment elements, each sheet adjustment element comprising:

a movable element comprising having an end positioned adjacent said planar surface at an initial position, said initial position being a first distance from said surface approximately equal to a thickness limit for said sheets of media, said end of said movable element moving in a first direction away from said surface and in a second direction toward said surface;

an actuator connected to said movable element, said actuator having electrical contacts that actuate said actuator; and a biasing member biasing said movable element in said first direction to position said end in said initial position, said end of said movable element moving in said first direction from said initial position as a result of said end of said movable element contacting said sheet of media as said sheet of media moves in said process direction, said electrical contacts contacting each other as a result of said movable element moving in said first direction, as a result of said electrical contacts contacting each other, said actuator moving said end of said movable element in said second direction to a pushing position to push said sheet of media against said surface, said pushing position being between said initial position and said surface, and after said moving said end of said movable element to said pushing position, said actuator allowing said biasing member to return said end of said movable element to said initial position.

12. The apparatus according to claim 11, said movable element contacting said sheet of media and pushing said sheet of media towards said surface when said movable element is in said pushing position.

13. The apparatus according to claim 11, said first direction and said second direction being within a single linear path, said single linear path being perpendicular to said surface.

14. The apparatus according to claim 11, said first distance being approximately equal to 90% of a height that a height-limiting structure extends in the first direction above the surface.

15. The apparatus according to claim 11, said pushing position being less than 80% of said first distance from said surface.

16. A printing apparatus comprising:

a vacuum conveyor belt having a planar surface with openings supporting sheets of print media, said vacuum conveyor belt moving said sheets of print media in a process direction;

an array of sheet adjustment elements positioned adjacent to said planar surface, each sheet adjustment element of said array being aligned with one of said rows of openings in said surface of said vacuum conveyor belt, and each said sheet adjustment element comprising:

a pin having an end at an initial position, said initial position being a first distance from said surface approximately equal to a thickness limit for said sheets of print media, said end of said pin moving in a first direction away from said surface and in a second direction toward said surface;

an actuator connected to said pin, said actuator having electrical contacts that actuate said actuator; and a spring biasing said pin in said first direction to position said end in said initial position, said end of said pin moving in said first direction from said initial position as a result of said end of said pin contacting said sheet of print media as said sheet of print media moves in said process direction, said electrical contacts contacting each other as a result of said pin moving in said first direction, as a result of said electrical contacts contacting each other, said actuator moving said end of said pin in said second direction to a pushing position to push said sheet of print media against said surface, said pushing position being between said initial position and said surface, and after said moving said end of said pin to said pushing position, said actuator allowing said spring to return said end of said pin to said initial position.

17. The printing apparatus according to claim 16, said pin contacting said sheet of print media and pushing said sheet of print media towards said surface when said pin is in said pushing position.

18. The printing apparatus according to claim 16, said first direction and said second direction being within a single linear path, said single linear path being perpendicular to said surface.

19. The printing apparatus according to claim 16, said first distance being approximately equal to 90% of a height that a print head structure extends in the first direction above the surface.

20. The printing apparatus according to claim 16, said pushing position being less than 80% of said first distance from said surface.

* * * * *